US011313227B2

(12) United States Patent
Plante

(10) Patent No.: US 11,313,227 B2
(45) Date of Patent: Apr. 26, 2022

(54) THREE-IN-ONE DRILLING, RESIN AND ROD INSERTION DEVICE

(71) Applicant: Sylvain Plante, Virginiatown (CA)

(72) Inventor: Sylvain Plante, Virginiatown (CA)

( * ) Notice: Subject to any disclaimer, the term of this patent is extended or adjusted under 35 U.S.C. 154(b) by 0 days.

(21) Appl. No.: 16/714,960

(22) Filed: Dec. 16, 2019

(65) Prior Publication Data

US 2020/0190981 A1 Jun. 18, 2020

Related U.S. Application Data

(60) Provisional application No. 62/917,610, filed on Dec. 18, 2018.

(51) Int. Cl.
*E21D 20/02* (2006.01)
*E21D 20/00* (2006.01)

(52) U.S. Cl.
CPC ..... *E21D 20/025* (2013.01); *E21D 20/003* (2013.01); *E21D 20/028* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,474,898 | A | 10/1969 | Montgomery | |
| 3,756,388 | A | 9/1973 | Murphy | |
| 4,193,715 | A | 3/1980 | Vass | |
| 4,194,858 | A | 3/1980 | Evans | |
| 4,229,124 | A * | 10/1980 | Frey | E21D 20/006 405/303 |
| 4,516,886 | A | 5/1985 | Wright | |
| 4,601,614 | A | 7/1986 | Lane et al. | |
| 4,664,561 | A | 5/1987 | Frease | |
| 5,544,980 | A | 8/1996 | Seegmiller | |
| 5,755,535 | A * | 5/1998 | Fox | E21D 11/006 405/288 |
| 6,413,019 | B1 * | 7/2002 | Coombs | E21D 20/006 173/38 |
| 6,793,445 | B1 | 9/2004 | Charlton et al. | |
| 10,253,628 | B2 | 4/2019 | Faulkner et al. | |
| 2001/0028833 | A1 | 10/2001 | Sager et al. | |
| 2007/0264088 | A1 | 11/2007 | Richter | |
| 2009/0324343 | A1 | 12/2009 | Eigemann et al. | |
| 2012/0251262 | A1 | 10/2012 | Salgado | |
| 2018/0066519 | A1 * | 3/2018 | Faulkner | E21D 20/028 |

* cited by examiner

*Primary Examiner* — Kyle Armstrong
(74) *Attorney, Agent, or Firm* — Christopher Pilling

(57) ABSTRACT

A device that allows for the sequential operations of hole drilling, resin and catalyst insertion and rod insertion in a single machine is provided. The drilling part uses a regular mining drilling machine that is fitted onto the device. Once the hole is drilled, a pipe is inserted into the hole. There are two possible versions of the pipe, a single pipe configured to work with an air cannon shooting resin tubes and a co-joined double pipe to inject resin and a catalyst in separate co-joined pipes so as to emerge unmixed at the end of the pipes. The next step consists in screwing in the rod into the hole, the twisting motion mixes resin and catalyst and in a matter of seconds, the rod is fully inserted and the chemical reaction has started. Because of the speed and accuracy of insertion and the thoroughness of mixing, more catalyst than usual can be used for a faster hardening of the resin, which secures the rod much better and faster.

5 Claims, 6 Drawing Sheets

32
34
18
21
27
54
16
26

THREE-IN-ONE DRILLING, RESIN AND ROD INSERTION DEVICE

BACKGROUND OF THE INVENTION

1. Field of the Invention

The present invention relates generally mining equipment but more particularly to a three-in-one drilling, resin and rod insertion device.

2. Description of Related Art

In mining operations, a wire mesh fence, better described as a metal lattice, is used for preventing the collapse of tunnels. The lattice holds together small fragments which could lead to large sections collapsing. In order to secure that lattice, after the lattice is loosely put in place on the ceiling and walls of the tunnel, a mining drill is used for drilling deep boles into the rock face. Once the hole is drilled, a worker has to push a sequence of tubes of resin and catalyst up the hole by hand and then he has to hold the rod to align it with the hole until the drill has pushed it in the hole a few centimeters. The action of pushing the rod in with a twist (as in a drill), pushes the catalyst into the resin and starts the chemical reaction. The insertion has to be done quickly since reaction time is quick since inserting the rod mixes the resin and the catalyst together so as to cause the resin to harden and thus secure the rod into the hole. The rod has a square head large enough to catch the lattice and secure against the rock face.

This operation requires the coordination of a raining drill machine and a fast worker inserting the tubes and guiding the rod in.

In order to solve the drawbacks associated with manual insertion, a recent development involves the use of a hose that is partially inserted into the hole and which uses air pressure to shoot the tubes into the hole—an air cannon of sort. The drawback with the air cannon is that a worker cannot guarantee if a tube went all the way to the bottom of the hole because if there is a small impediment, such as a loose rock inside the hole, the tube can get stuck and not reach the bottom of the hole. It is very difficult to try to remove or push the tube because once the tube is punctured, the chemical reaction starts and the resin quickly hardens. These tubes are in fact much like sausages inside their skin, very fragile. The resin and catalyst are side by side inside that skin and the two are mixed when the rod is inserted in a rotating fashion as it punctures and twist the resin and catalyst.

Another recent development is U.S. Pat. No. 10,253,628 which describes three variations for the insertion of resin and catalyst among other elements of the invention. One variant is the use of a pair of parallel tubes pushed inside the hole by way of rollers. Another variant has one large diameter tube and one small diameter hose wherein the small diameter hose is fitted inside the large diameter tube and wherein the resin is injected into the small hose and the catalyst is injected around it inside the tube. This latter configuration creates a lot of friction because the catalyst is rubbing against the outer tube and against the inner hose and by doing so will need a lot of pressure to make it come out of the tube and hose. It is not clear whether the tube is flexible or rigid in nature but the description seems to point to a flexible hose on the inside. The third variant is a single hose that is partitioned in the middle by way of a plastic membrane. Any variation in pressure between the two partitions, given that they are separated with a flexiple plastic membrane means that the membrane would curve outwardly towards the side with a lesser pressure which changes the mix ratio in an uncontrollable fashion. Moreover, the membrane can also rupture causing the resin and catalyst to mix and harden inside the hose, causing it to burst.

Applicant, who happens to be a working miner who has experience with such machines. More specifically a machine that uses two parallel hoses or flexible tubes configuration as well as the hose within a hose configuration, (but not made by the same company that is named as assignee in the U.S. Pat. No. 10,253,628), can attest that the use of flexible hoses does not work (U.S. Pat. No. 10,253,628 seems to show both rigid and flexible tubings depending on the figures) and, although not having personal experience with the split hose (the single hose with a partition in the middle of U.S. Pat. No. 10,253,628), he is pretty convinced that it would behave as described hereinabove based on what he can infer from his personal experience with various machines using similar hardware.

As for the second variant with the concentric tubes, in real world use, because the mesh is installed prior to the drilling, some rocks fall off around the drilling area due to the vibrations. These rocks are retained by the mesh but partially interfere when proceeding to the insertion of the tube. The loose rocks get in the way and any type of flexible tube or hose, which is diverted off course and is pushed against the hard rock, missing the hole. Also, there is always a gap between where the hose comes out and where the hole drilled in the rock is located. This gap can vary from 6 inches to 2 feet. When the hose is pushed out, it already starts to bend to one side or other after only 3 inches, making it almost impossible to get it in the hole the longer the gap is. A hose cannot enter into the hole, even if using a non-flexible hose or tube or even a metal pipe as taught by way of rollers pushing the hose/tube used in U.S. Pat. No. 10,253,628. The use of rollers is not strong enough to push against the rocks (or any obstruction in the hole) and it leads to the rollers simply skidding on the hose/tube. This is even worse with the first variant which has two flexible hoses.

Also after a successful hose insertion, those hoses are pulled out as they dispense the resin/catalyst, and as the hose is coming out, if there is a small obstruction inside the hole which causes the rollers to slip and prevent the hose from coming out at the right speed, then the catalyst/resin mix starts to get hard as it slides down along the sides of the hose/tube, causing it to jam and be stuck inside the hole. In such cases, we have to pull with the boom until the hose ruptures and replace it with a new one. Even if the hose can be successfully pulled out, there is always the risk that some of the resin/catalyst will drip down from the hole and harden on the rollers, which will required to be cleaned to prevent jamming.

Sometimes extreme pressure has to be applied in order for the resin/catalyst to be pushed through the hoses that are over 15 feet long. Anything flexible will not work because as soon as resin and catalyst are a bit thicker caused by simply sitting in the hoses between shift or receiving a batch of resin that is thicker than usual because of the extreme temperature variations—from −30° C. to 30° C. which it can be subjected to during the shipping process. As a result, it affects fluidity and viscosity differently between the two products. For example, a resin that is thicker than usual needs more pressure, causing the hose to burst. In actual practice, we have to change the hoses every day, sometimes three times a day. Hoses are $300 and take at least one hour to change them.

The roller system of U.S. Pat. No. 10,253,628, as seen if FIG. 9 in that patent is also problematic when applied on a Configuration using two hoses one beside each other as it is very hard to get inside the hole and push them up. And when using the twin tubes inside a larger tube as shown in FIGS. 12A-D, it is not so efficient because the two hoses have to fit inside a tube, which means a lot of empty space, as shown in FIG. 6 of applicant's invention.

Also, the roller system has many moving parts (chains, gears, rollers, rollers adjustments, bearings) which need daily repairs, maintenance and cleaning.

In real life they can't use a rigid pipe with the roller system. They have no choice but to use a flexible hose because the roller assembly is about 15 inches wide so it doesn't fit between the two drills pushing the drill steel and the ribar/rod, which only has about 4 inches between them. So the roller system has to be sitting higher than the two drills and use a guide made out of steel tubing going from the front of the rollers dropping down about 12 inches in the small space between the two drills and all the way to the front to make it come out at the right place at the other end. This guide has two 45 degrees bend in it, so only a flexible hose can be used to be pushed through it by the rollers From personal experience, the machine that Applicant has used in the past, could not properly engage the hole most of the time, was in constant need of cleanup, repairs, servicing adjustments, etc. On average, only 5 holes per work shift could be drilled when it should be expected to drill at least 40.

There certainly is a need for improvement here in the hose design and its mode of insertion. Especially since progress in drilling new tunnels depends upon the speed at which the tunnel roof can be secured. Such delays increase mining operations costs, which makes the mining operation non profitable. Many mines were abandoned in the past because of this situation.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In order to do so, a device enabling sequential operations of hole drilling, resin and catalyst insertion, and rod insertion is provided, the device comprising a drilling machine configured to chill a hole; a pipe configured to be inserted into the hole, wherein the pipe is a co-joined double pipe configured to inject a resin and a catalyst via each pipe of the co joined double pipe such that the resin and the catalyst emerges unmixed at an end of the co-joined double pipe; a rod configured to be screwed via a twisting motion into the hole, wherein the twisting motion is configured to mix the resin the catalyst causing a chemical reaction to harden the resin such that the rod is secured in the hole.

In one embodiment, the drilling machine comprises a hydraulic drill motor and a drill bit. In one embodiment, the hydraulic drill motor is mounted to a first pivoting frame, which is configured to pivot around a pivot point. In one embodiment, the pivoting action of the first pivoting frame enables room for a second pivoting frame to line up with the drilled hole such that the co-joined double pipe may be inserted into the hole. In another embodiment, the co-joined pipe double pipe includes a smaller diameter pipe inside a larger diameter pipe, wherein the smaller diameter pipe is configured to hold the catalyst and the larger diameter pipe is configured to hold the resin. In another embodiment, the co-joined double pipe is configured to be extracted leaving the resin and the catalyst in the hole. In yet another embodiment, a compressor configured to eject the resin and the catalyst from the co-joined double pipe is provided. In one embodiment, the rod is spun and pushed up by the hydraulic drill rod motor. In combination the worm screw pushes the double pipe inside the hole to ensure that the double pipe properly aligns and penetrates the hole.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figures 1A, 1B, 1C:
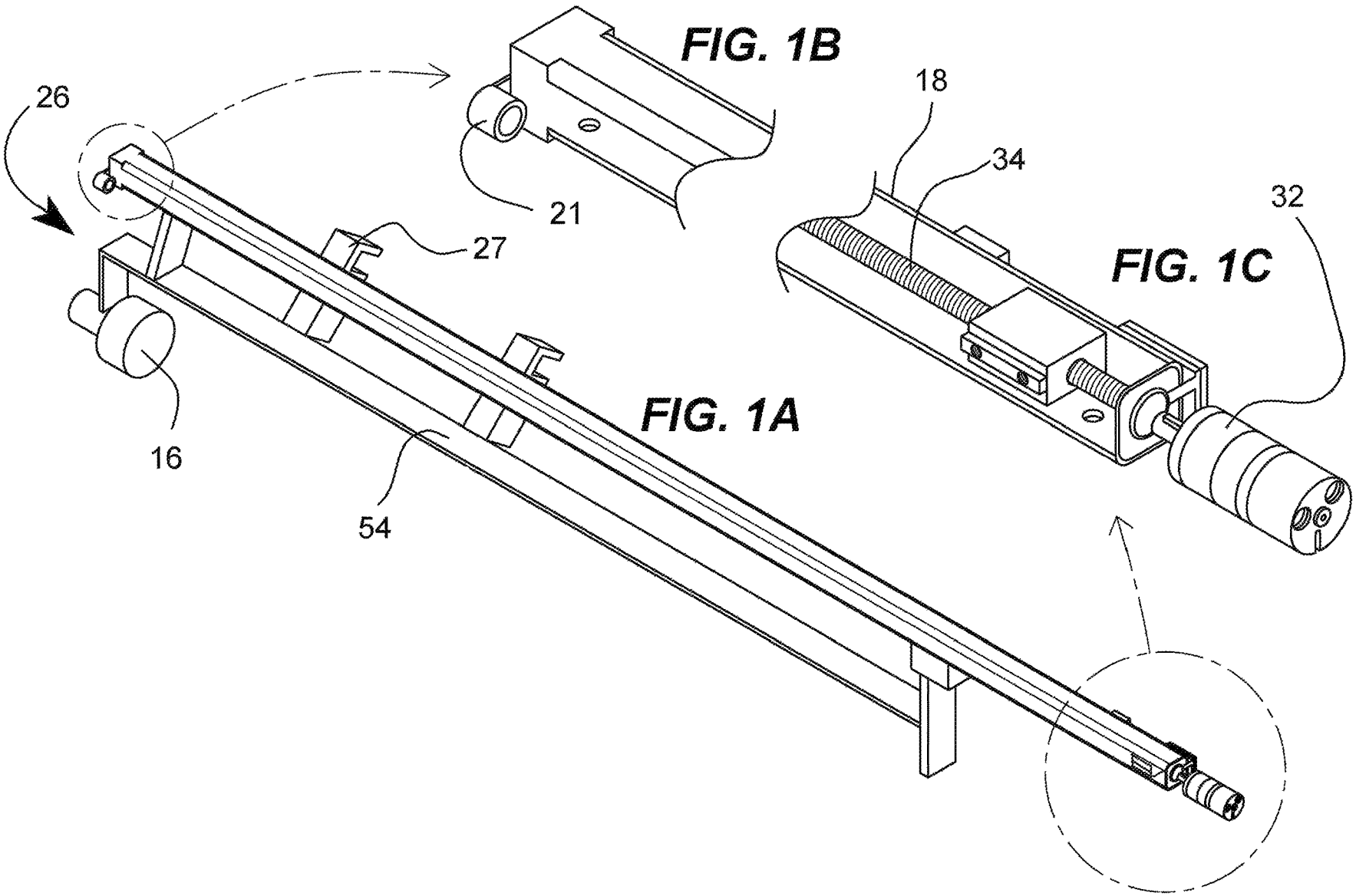
FIGS. 1A-C are isometric views of a frame member and details of the hydraulic motor and worm screw for use on the second frame member according to an embodiment of the present invention.
Figure 2A:
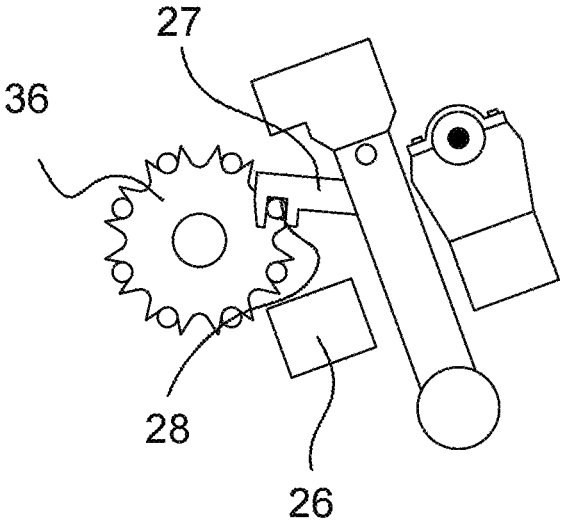
FIGS. 2A-C are top views of the carousel and grappler assembly and the three pivoting frames according to an embodiment of the present invention.
Figure 2B:
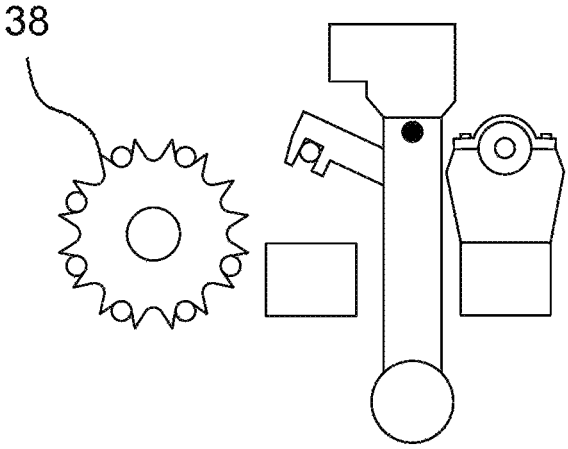
Figure 2C:
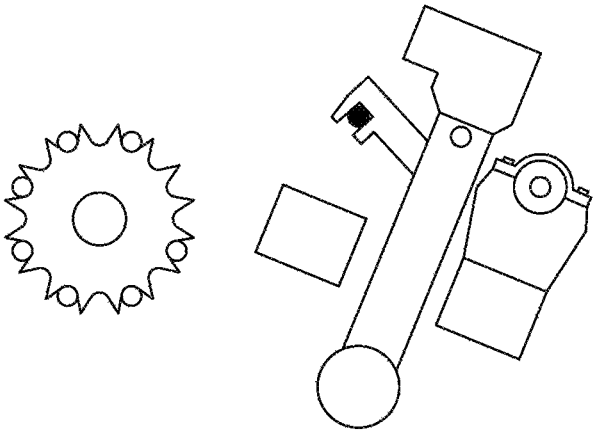
Figure 3A:
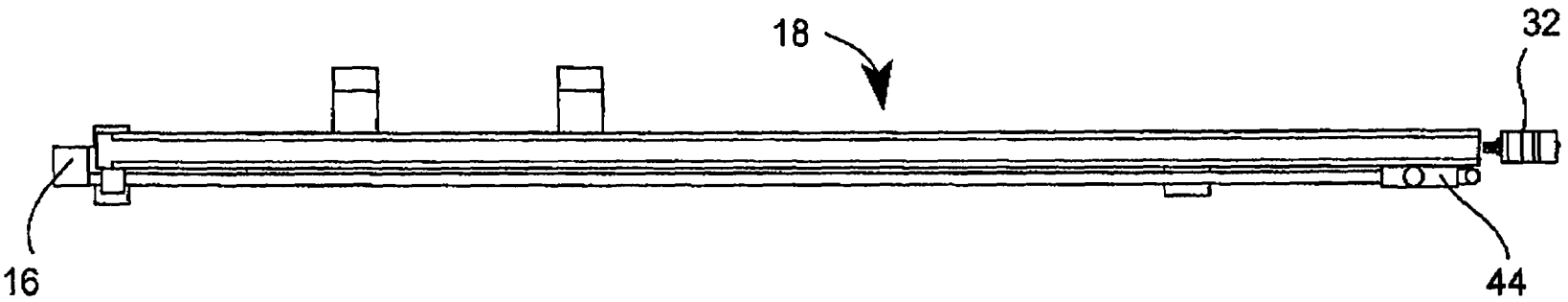
FIGS. 3A-B are top and side views of the second pivoting frame according to an embodiment of the present invention.
Figure 3B:
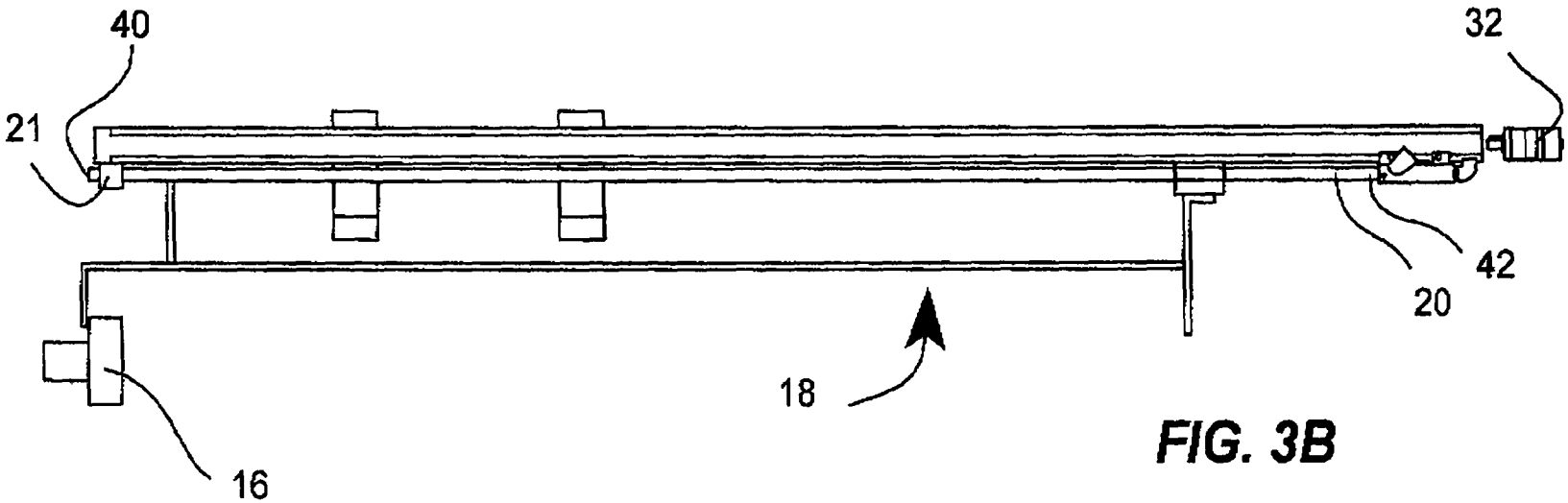

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein.

The provided three-in-one drilling, resin and rod insertion device is configured for sequential operations of hole drilling by way of a drill bit 11 driven by a hydraulic drill motor 14 which is mounted on a first pivoting frame 12. Once a hole has been drilled, the pivoting frame 12 pivots around a pivot point 16. The pivoting action leaves room for a second pivoting frame 18 to line up with the drilled hole so that a co-joined double pipe 20 may be inserted into the hole. In some embodiments, the co-joined double pipe 20 is comprised of a small diameter pipe 22 located inside a large diameter pipe 24, wherein the small diameter pipe 22 holds a catalyst and the large diameter pipe 24 holds a resin.

After full insertion of the co-joined double pipe 20, it is extracted while leaving the resin and the catalyst in the hole. Both substances have the consistency of toothpaste and similar to multicolored toothpaste, the two substances do not readily mix. A compressor (not shown) is configured to push the substances into the co-joined double pipe 20 while also applying pressure so that the substances are ejected from the co-joined double pipe 20 as the co-joined double pipe 20 is retracted out of the bole.

When using a single pipe (not shown) to which a hose is connected (the hose is an existing and well known machine in the mining industry such as the ones made by the Sandvick® company and need not be further discussed herein and the pipe is a standard pipe comparable to plumbing pipes that are typically rigid, the operations are similar except that the resin and catalyst come in tubes resembling sausages, as described herein above. These tubes are currently used in the industry on machines such as those made by Sandvik®, for example, but are pushed by way of an air cannon. As mentioned earlier, the problem with the air cannon is that if there is the smallest impediment, the tube can get stuck and not reach the bottom of the hole. This problem can be eliminated by connecting the flexible hose of the air cannon to the single pipe of Applicant's invention. The inventiveness aspect is in the use of a standard pipe along with this invention so that the single pipe is pushed to the bottom of the hole, just as with the co-joined double pipe 20 and is retracted the equivalent of one tube length (typically 16 inches) and a first tube is shot out of the pipe, which is then retracted by another tube length to allow for the second tub; and so on.

Then the co-joined double pipe 20 or the single pipe is fully retracted, and the second pivoting frame 18 pivots out of the way so as to leave room for a third pivoting frame 26. At this point, the resin and catalyst are not mixed, simply positioned side by side inside the hole, or inside the tubes. The next step consists of screwing-in a rod 28 into the hole. The twisting motion mixes resin and catalyst and in a matter of seconds, the rod 28 is fully inserted and the chemical reaction has started. The advantage of using a rigid pipe, whether single or co-joined double pipe as in this case, is that even if there is a blockage due to an impediment or hardening of resin that might have happened at the output of the co-joined double pipe, applying more pressure is possible until the resin pumping system jams and still avoid any rupture anywhere in the system.

The three-in-one drilling, resin and rod insertion device is moved about and positioned by way of a boom crane vehicle, as is known in the art (Sandvik® DX800 for example). In the first pivoting frame 12, essentially incorporates a mining drill apparatus 14. In some embodiments, a hydraulic motor (not shown) generally located behind the hydraulic drill motor 14 is configured to rotate a sprocket (not shown) that is connected to a chain 50 so as to move the chain 50 in two directions, which acts as a means for moving the hydraulic drill motor 14 and the drill bit 11 up and down. Similarly, the rod 28 is moved via a second hydraulic motor (not shown) which is configured to move a second chain 50' configured to move a rod hydraulic motor 52 up and down. A set of grapplers 27 via the rod hydraulic motor 52 is configured to take a rod 28 from a carousel 36. As best seen in FIGS. 1A and 2A-C, the set of grapplers 27 are connected to a shaft which is mounted on beam 54, wherein the set of grapplers 27 are configured to swing down about 10 inches to grab the rod 28 in the carousel 36 and then swing back up 10 inches to leave room for the drill 52 to go by and push the rod 28 in the hole. A carousel hydraulic motor (not shown) is configured to rotate the carousel.

A worm screw 34 which is spun via a worm screw motor 32, typically a hydraulic motor, is used to push the co-joined double pipe 20 or the single pipe. The worm screw 34 is contained inside the second pivoting frame 18. The use of a worm screw 34 to push the double pipe 20 in the hole ensures that there is enough force applied so that the double pipe 20, which is rigid and can thus push through any impediment without bending. The use of a worm screw 34 makes that a direct drive, which makes it easy to push the pipe in or out of the hole every time without any slippage even if there is obstruction in the hole. There is always a space between where the pipe comes out and where it enters the hole drilled in the rock, sometimes even up to two feet, so the use of a straight rigid pipe makes it easy to line it up with the hole every time regardless of how big the gap is between where the pipe comes out and where it enters the hole. Moreover, because the worm screw is not under the pipe but rather to the side and parallel to it, it is not affected by dripping resin and catalyst since they do not fall on it. Moreover, the worm screw is inside the pivoting frame that protects it.

Figure 4A:
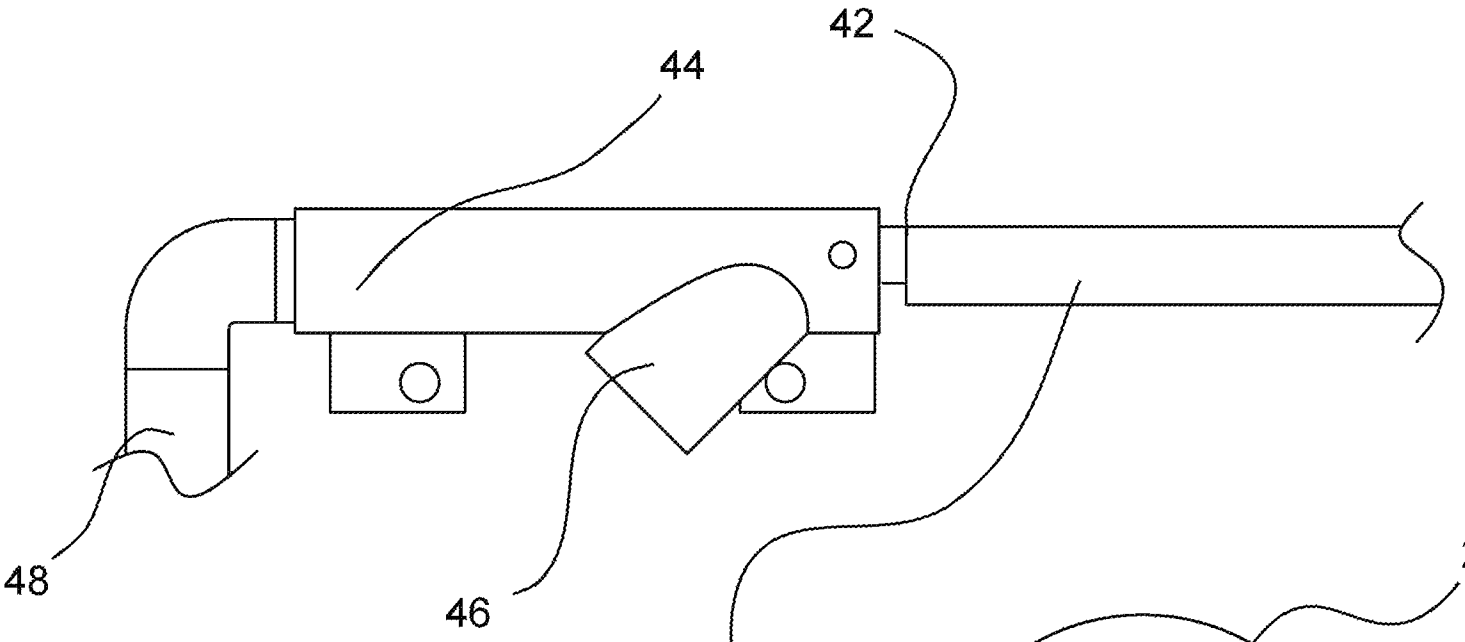
FIGS. 4A-B are side view and cutaway views of the tip of the co joined double pipe according to an embodiment of the present invention.
Figure 4B:
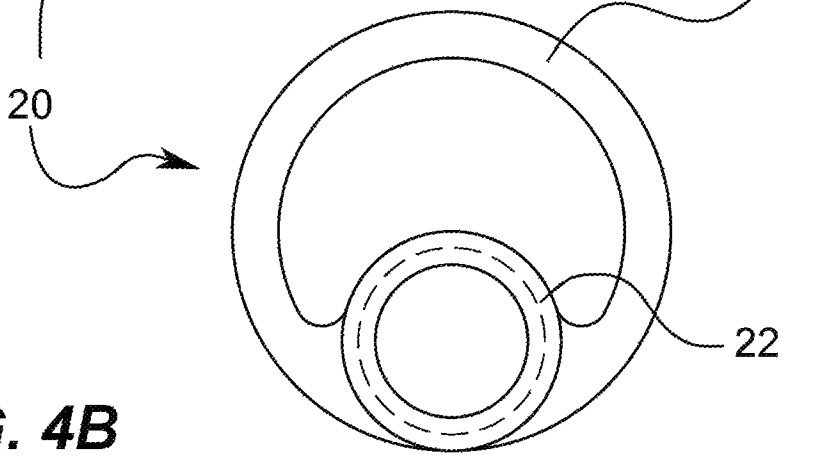
Figure 5:
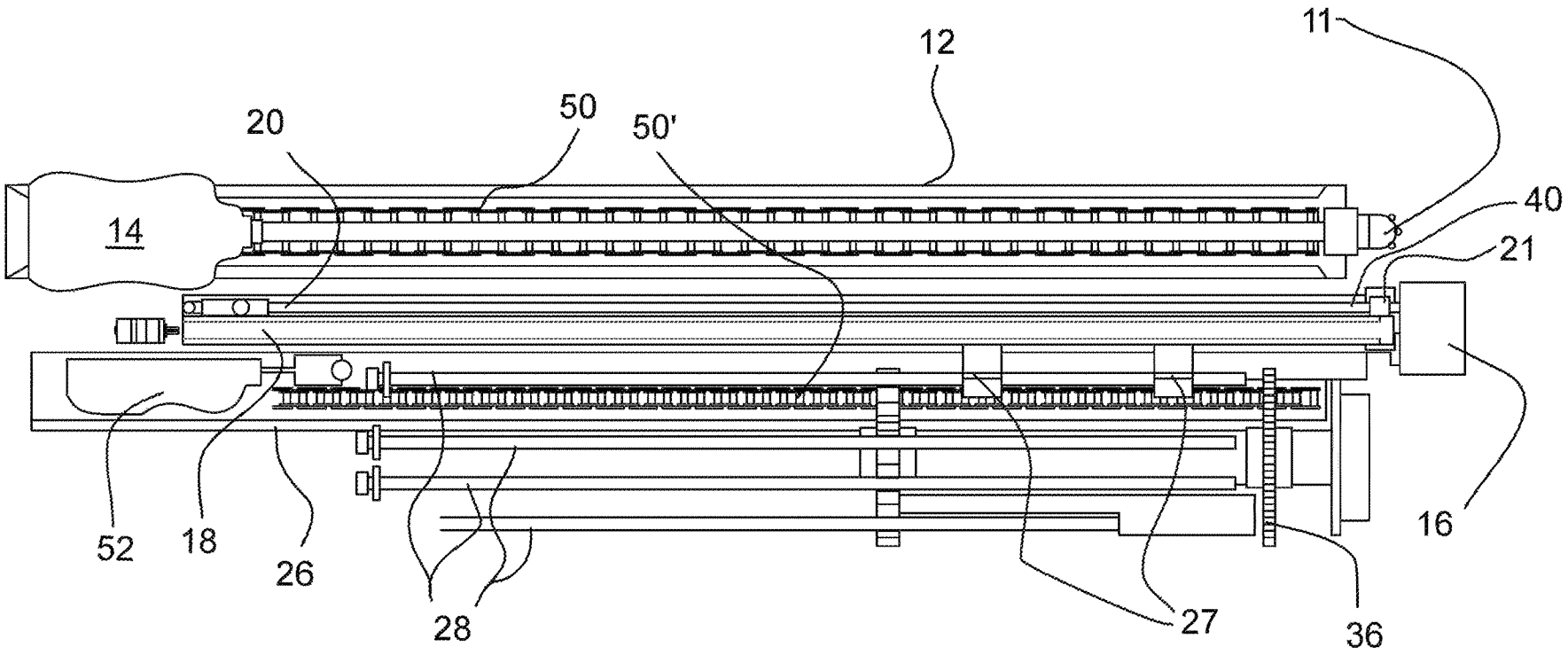
FIG. 5 is a top view of the device according to an embodiment of the present invention.
Figure 6:
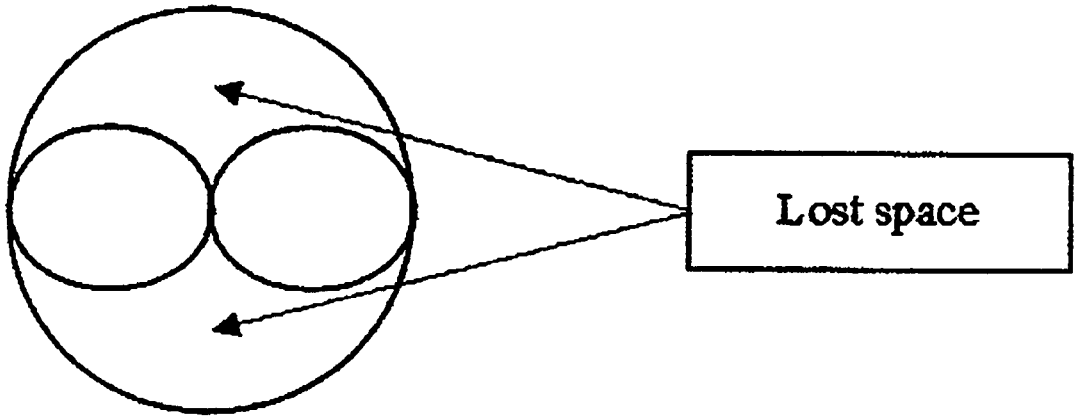
FIG. 6 is a schematic view showing the lost space when using two hoses fitted inside a tube.

As best seen in FIG. 1B, the co-joined double pipe 20 slides through a bushing 21 and, as best seen in FIGS. 4A and 5, has a distal end 40 from which the substances are expelled and a proximal end 42 (where the hose from the air cannon would connect in the case of the single pipe) having a first and a second hose connector 44, 46 wherein the first hose connector 44 releasably connects a catalyst hose 48 to the small diameter pipe 22, and the second hose connector 46 releasably connects a resin hose (not shown) to the large diameter pipe 24. Both hoses connect to their respective substance tanks and a compressor (not shown) provides pressure to those tanks. The co joined double pipe 20 or single pipe use a worm screw 34' to move in and out of the hole but do not require any rotation like the rod 28.

The combination of a double pipe 20 that is rigid and a worm screw 34 to push the pipe inside the hole ensures that the double pipe 20 can easily align with and penetrate the bole all the way every time and without any slippage. This allows for an operator to drill 50 to 60 holes in a shift instead of less than 10 using other known devices. Time and money are saved.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A device enabling sequential operations of hole drilling, resin and catalyst insertion, and rod insertion, the device comprising:

a drilling machine comprising a hydraulic drill motor and a drill bit configured to drill a linear hole, wherein the hydraulic drill motor is mounted to a first pivoting frame which is configured to pivot around a pivot point;

a second pivoting frame configured to line up with the linear hole such that a linear pipe is enabled to be inserted into the linear hole, wherein the linear pipe contains a sequence of catalyst and resin substance or is a co-joined linear double pipe configured to inject a resin and a catalyst via each pipe of the linear co-joined double pipe such that the resin and the catalyst emerge unmixed at an end of the linear co-joined double pipe;

a rod configured to be screwed via a twisting motion into the linear hole, wherein the twisting motion is configured to mix the resin and the catalyst causing a chemical reaction to harden the resin such that the rod is secured in the linear hole; and a worm screw contained inside the second pivoting frame, wherein the worm screw is spun via a worm screw motor to push the linear co-joined double pipe or the linear pipe inside the linear hole and pull the linear co-joined double pipe or the linear pipe out of the linear hole.

2. The device of claim 1, wherein the linear co-joined pipe double pipe includes a smaller diameter pipe inside a larger diameter pipe, wherein the smaller diameter pipe is configured to hold the catalyst and the larger diameter pipe is configured to hold the resin.

3. The device of claim 1, wherein the linear co-joined double pipe is configured to be extracted leaving the resin and the catalyst in the linear hole.

4. The device of claim 1, further comprising a compressor configured to eject the resin and the catalyst from the linear co-joined double pipe.

5. The device of claim 1, wherein the rod is spun and pushed up by the hydraulic drill motor.

* * * * *